US010737364B2

(12) United States Patent
Xue et al.

(10) Patent No.: US 10,737,364 B2
(45) Date of Patent: Aug. 11, 2020

(54) MULTIFUNCTIONAL WHEEL BURR REMOVING DEVICE

(71) Applicant: CITIC Dicastal CO.,LTD, Qinhuangdao (CN)

(72) Inventors: Bowen Xue, Qinhuangdao (CN); Dongguang Yang, Qinhuangdao (CN); Qiufang Li, Qinhuangdao (CN); Jiandong Guo, Qinhuangdao (CN); Yongwang Zhao, Qinhuangdao (CN)

(73) Assignee: CITIC DICASTAL CO., LTD, Qinhuangdao, Hebei (CN)

( * ) Notice: Subject to any disclaimer, the term of this patent is extended or adjusted under 35 U.S.C. 154(b) by 96 days.

(21) Appl. No.: 15/605,320

(22) Filed: May 25, 2017

(65) Prior Publication Data

US 2018/0264617 A1 Sep. 20, 2018

(30) Foreign Application Priority Data

Mar. 20, 2017 (CN) ..... 2017 1 0167296

(51) Int. Cl.
*B24B 9/04* (2006.01)
*B24B 29/04* (2006.01)
(Continued)

(52) U.S. Cl.
CPC ..... *B24B 27/0076* (2013.01); *B24B 5/12* (2013.01); *B24B 5/44* (2013.01); *B24B 9/04* (2013.01);
(Continued)

(58) Field of Classification Search
CPC .. B24B 5/16; B24B 5/165; B24B 5/44; B24B 9/00; B24B 9/04; B24B 27/0076; B24B 29/005; B24B 29/04; B24B 19/00; B24B 9/02; B24B 21/02; B24B 21/12; B24B 21/16; B24B 5/12; B24B 5/35;
(Continued)

(56) References Cited

U.S. PATENT DOCUMENTS 3,258,804 A * 7/1966 Fowle ..... B24B 5/225 15/104.011
4,216,560 A * 8/1980 Schmidt ..... B24B 41/06 15/268
(Continued)

FOREIGN PATENT DOCUMENTS

GB 667407 A * 2/1952 ..... B24B 5/44
JP 3044289 B2 * 5/2000
JP 3091417 B2 * 9/2000

*Primary Examiner* — Eileen P Morgan
(74) *Attorney, Agent, or Firm* — Calfee, Halter & Griswold LLP

(57) ABSTRACT

The present application discloses a multifunctional wheel burr removing device, comprising a synchronous clamping drive system, a first burr brushing system, an upper burr brushing system and a second burr brushing system. The multifunctional wheel burr removing device in use may remove burrs of four parts. And the four parts are as follows: end faces of upper rims, wheel wells, cutting positions of sides of upper rims and fronts of wheels having different diameters and different heights. So the production efficiency is very high; and simultaneously, the device has the characteristics of high automation degree, advanced process, strong generality, safety and stability.

1 Claim, 3 Drawing Sheets

(51) Int. Cl.

| | |
|---|---|
| ***B24B 5/12*** | (2006.01) |
| ***B24B 5/44*** | (2006.01) |
| ***B24B 27/00*** | (2006.01) |
| ***B24B 29/00*** | (2006.01) |
| ***B24B 41/00*** | (2006.01) |
| ***B24B 41/06*** | (2012.01) |

(52) U.S. Cl.
CPC ..... *B24B 27/0023* (2013.01); *B24B 27/0069* (2013.01); *B24B 29/005* (2013.01); *B24B 29/04* (2013.01); *B24B 41/005* (2013.01); *B24B 41/067* (2013.01)

(58) Field of Classification Search
CPC ..... B24B 27/0023; B24B 27/0069; B24B 41/005; B24B 41/067; B24B 49/12
USPC ..... 451/65
See application file for complete search history.

(56) References Cited

U.S. PATENT DOCUMENTS 4,550,464 A * 11/1985 Messing ..... B60S 3/042 15/53.4
4,723,563 A * 2/1988 Kane ..... B60C 25/0596 118/320
5,134,807 A * 8/1992 Keefe ..... B24B 7/16 451/259
5,161,281 A * 11/1992 Hanen ..... B08B 1/04 15/88.3
5,762,542 A * 6/1998 Sandvold ..... B24B 9/002 451/188
5,876,501 A * 3/1999 Doan ..... B05C 1/027 118/244
7,351,130 B1 * 4/2008 Chang ..... B24B 7/06 451/11
9,782,866 B1 * 10/2017 Xue ..... B24B 9/04
9,981,309 B2 * 5/2018 Xue ..... B05B 13/0221
10,010,993 B2 * 7/2018 Xue ..... B24B 9/04
2007/0037497 A1 * 2/2007 Tanaka ..... B24B 5/44 451/312
2007/0042678 A1 * 2/2007 Tanaka ..... B24B 5/44 451/5
2013/0102233 A1 * 4/2013 Cheon ..... B24B 27/033 451/331
2014/0194038 A1 * 7/2014 Lowe ..... B24B 9/04 451/11
2015/0273493 A1 * 10/2015 Xue ..... B05B 13/0228 239/224
2015/0273588 A1 * 10/2015 Bowen ..... B23B 5/28 82/104
2015/0273595 A1 * 10/2015 Xue ..... B23B 47/281 408/97
2015/0276542 A1 * 10/2015 Bowen ..... G01M 3/103 73/45.6
2015/0306740 A1 * 10/2015 Xue ..... B24D 13/10 451/468
2016/0184889 A1 * 6/2016 Xue ..... B22D 17/2236 164/270.1
2016/0184955 A1 * 6/2016 Xue ..... B24B 9/04 451/283
2016/0184958 A1 * 6/2016 Xue ..... B24B 29/005 451/59
2016/0207173 A1 * 7/2016 Liu ..... B23Q 1/58
2016/0207174 A1 * 7/2016 Liu ..... B23Q 3/062
2016/0236459 A1 * 8/2016 Xue ..... B41F 3/54
2016/0288282 A1 * 10/2016 Liu ..... B23Q 1/525
2016/0311215 A1 * 10/2016 Xue ..... B41F 17/006
2016/0311216 A1 * 10/2016 Xue ..... B41F 17/28
2016/0346844 A1 * 12/2016 Xue ..... B23B 5/28
2016/0346887 A1 * 12/2016 Xue ..... B23Q 7/043
2016/0353873 A1 * 12/2016 Xue ..... A46B 13/02
2016/0354798 A1 * 12/2016 Xue ..... B05B 13/0285
2016/0354891 A1 * 12/2016 Xue ..... B24B 5/44
2016/0354892 A1 * 12/2016 Xue ..... B60C 29/02
2016/0361787 A1 * 12/2016 Yang ..... B23Q 3/062
2018/0333821 A1 * 11/2018 Xue ..... B24B 9/005
2018/0338353 A1 * 11/2018 Chang ..... H05B 6/102

* cited by examiner

MULTIFUNCTIONAL WHEEL BURR REMOVING DEVICE

CROSS-REFERENCE TO RELATED APPLICATIONS

This application claims priority to Chinese Patent Application No. 201710167296X, filed on Mar. 20, 2017, which is hereby incorporated by reference in its entirety.

TECHNICAL FIELD

The present application relates to a burr removing device, and specifically to a multifunctional wheel burr removing device.

BACKGROUND ART

In the machining process of an aluminum alloy wheel, because the cutting positions of procedures are different, burrs are often produced on four parts, i.e., the end face of the upper rim, the wheel well, the sides of the upper rim and the front, and if the burrs are not removed timely, the coating effect is influenced and corrosion also occurs prematurely. At present, there is no equipment for simultaneously removing the burrs on the four parts and being compatible with wheels of different diameters and different heights.

SUMMARY OF THE INVENTION

An object of the present application is to provide a multifunctional wheel burr removing device, which may remove burrs on end faces of upper rims, wheel wells, cutting positions of sides of upper rims and fronts of wheels of different diameters and different heights.

In order to fulfill the aim, the technical solution in the present application is that a multifunctional wheel burr removing device comprises a frame, a gear, two racks, a first bottom plate, a first guide rail, a first sliding plate, two first bearing seats, two first shafts, four V-shaped rollers, a first platform, a second guide rail, a second bottom plate, a first servo electric cylinder, a first vertical plate, a third guide rail, a first brush, a first lifting plate, a first motor, a second servo electric cylinder, a second ring brush, a first ring brush, a second bearing seat, a third bearing seat, a transmission shaft, an upper lifting plate, four guide posts, four guide sleeves, two cylinders, an upper motor, a third servo electric cylinder, a fourth guide rail, a second vertical plate, a first servo motor, a first belt pulley, a synchronous belt, a second belt pulley, a second servo motor, a second shaft, a fourth bearing seat, a second lifting plate, a second support frame, a second brush, a fourth servo electric cylinder, a third bottom plate, a fifth guide rail, a second platform, a fifth servo electric cylinder, two fifth bearing seats, two third shafts, a second sliding plate and a third servo motor.

A synchronous clamping drive system includes: the gear is fixed above the first bottom plate; the first sliding plate and the second sliding plate are installed above the first bottom plate via the first guide rail; below the first sliding plate and the second sliding plate are respectively fixed two racks, which are engaged with the gear; two first bearing seats are fixed at the upper end of the first sliding plate; two fifth bearing seats are fixed at the upper end of the second sliding plate; two first shafts are installed in the first bearing seats via bearings, and above the two first shafts are respectively fixed a V-shaped roller, too; two third shafts are installed in the fifth bearing seats via bearings, and the V-shaped rollers are also respectively fixed above the two third shafts; the fifth servo electric cylinder is fixed on the right of the frame, and the output end of the fifth servo electric cylinder is connected with the second sliding plate; the third servo motor is fixed below the second sliding plate, and the output end of the third servo motor is connected with the lower part of one of the third shafts.

A first burr brushing system includes: the second bottom plate is installed above the first platform via the second guide rail; the first vertical plate is fixed above the second bottom plate; the first servo electric cylinder is fixed on the left of the first platform, and the output end of the first servo electric cylinder is connected with the second bottom plate; the first lifting plate is installed on the right of the first vertical plate via the third guide rail; the first motor is fixed above the first lifting plate, and the output end of the first motor is connected with the first brush; the second servo electric cylinder is fixed at the top of the first vertical plate, and the output end of the second servo electric cylinder is connected with the first lifting plate.

An upper burr brushing system includes: the third bearing seat is fixed below the upper lifting plate; the transmission shaft is installed inside the third bearing seat via a bearing; the first ring brush is fixed below the transmission shaft; the second bearing seat is installed outside the third bearing seat via a bearing, and the second ring brush is fixed at the lower end of the second bearing seat; the second ring brush is engaged with the first ring brush; the four guide posts and the upper motor are all fixed above the upper lifting plate; the output end of the upper motor is connected with the upper part of the transmission shaft; the guide sleeves matched with the four guide posts are all fixed at the top of the frame; two cylinders are fixed at the top of the frame, and the output ends of the two cylinders are articulated with the upper part of the upper lifting plate.

A second burr brushing system includes: the third bottom plate is installed above the second platform via the fifth guide rail; the fourth servo electric cylinder is fixed above the second platform, and the output end of the fourth servo electric cylinder is connected with the third bottom plate; the second vertical plate is fixed above the third bottom plate; the second lifting plate is installed on the left of the second vertical plate via the fourth guide rail; the third servo electric cylinder is fixed at the top of the second vertical plate, and the output end of the third servo electric cylinder is connected with the upper part of the second lifting plate; the fourth bearing seat is fixed on the left of the second lifting plate; the second shaft is installed inside the fourth bearing seat via a bearing; the second servo motor is fixed on the right of the second lifting plate, and the output end of the second servo motor is connected with the right of the second shaft; the right of the second support frame is fixed on the left of the second shaft; the second brush is installed inside the second support frame, and the first belt pulley is fixed above an intermediate shaft of the second brush; the first servo motor is fixed above the second support frame, and the second belt pulley is fixed at the output end of the first servo motor; and the first belt pulley is connected with the second belt pulley via the synchronous belt.

In practical use, a wheel has burrs on four parts, i.e., the end face of the upper rim, the wheel well, the sides of the upper rim and the front, and different wheels have different diameters and different heights, and the fifth servo electric cylinder clamps a wheel via the gear and the racks, and the third servo motor drives the clamped wheel to rotate; the first servo electric cylinder drives the first brush via the second guide rail to carry out feed motion towards the wheel, and the first motor drives the first brush to rotate; the second servo electric cylinder drives the rotating first brush via the third guide rail to contact the end face of the upper rim of the wheel, thus removing burrs thereon; the upper motor drives the first ring brush to rotate via the transmission shaft, and the second ring brush is driven to rotate by engagement of the first ring brush and the second ring brush; the cylinders drive the rotating first ring brush and second ring brush via the guide posts to contact the front of the wheel, thus removing burrs on the front; the fourth servo electric cylinder drives the second brush via the fifth guide rail to carry out feed motion towards the wheel; the first servo motor drives the second brush to rotate via the synchronous belt; the third servo electric cylinder drives the second brush to move up and down via the fourth guide rail, and when the rotating second brush contacts the wheel well of the wheel, the burrs thereon can be removed; the second servo motor drives the second brush to turn over 90 degrees, the second brush is vertical, and when the second brush contacts the wheel, the cutting burrs on the side of the upper rim can be removed.

The multifunctional wheel burr removing device of the present application in use may remove burrs on end faces of upper rims, wheel wells, cutting positions of sides of upper rims and fronts of wheels of different diameters and different heights, so the production efficiency may be very high; and simultaneously, the device has the characteristics of high automation degree, advanced process, strong generality, safety and stability.

Figure 1:
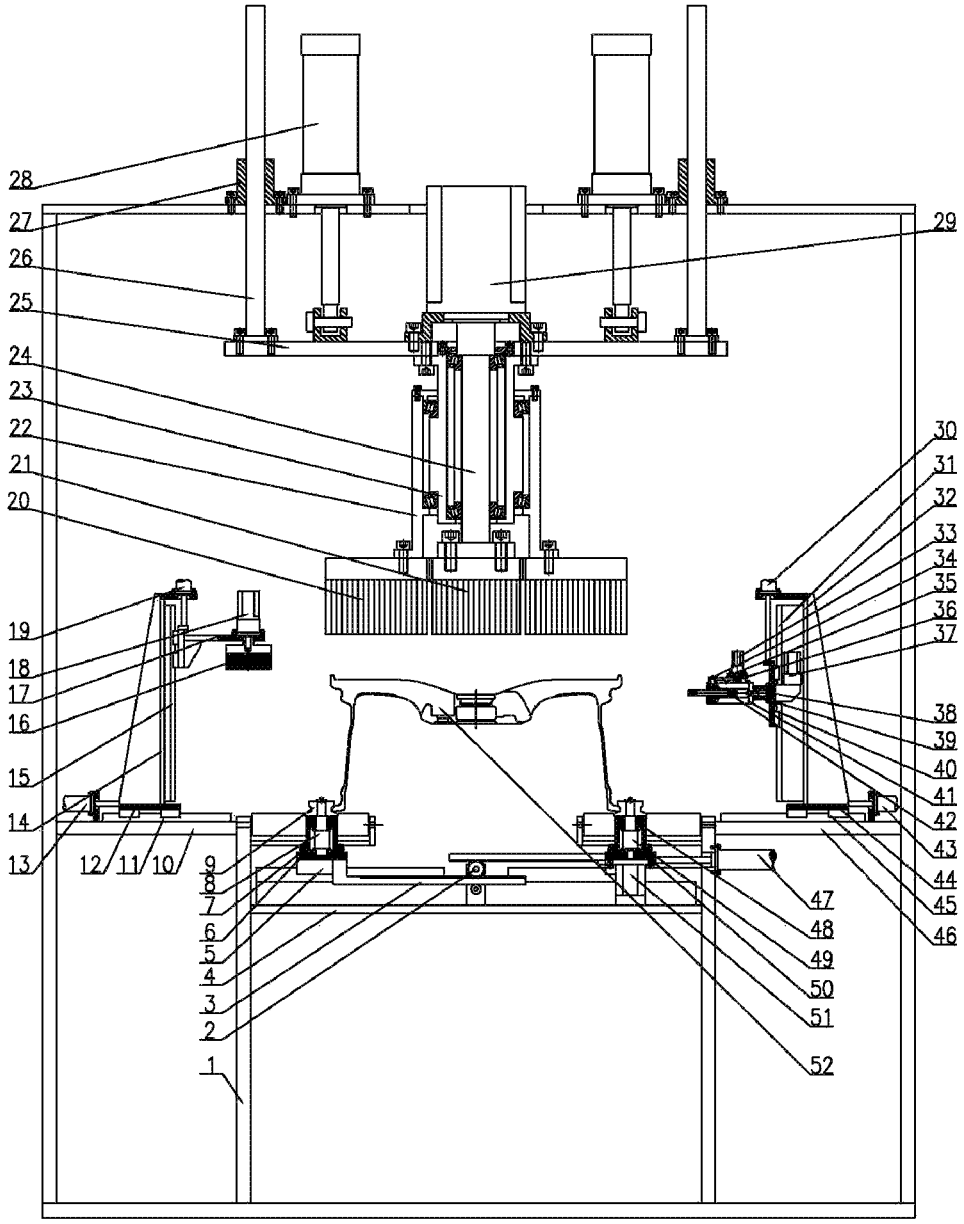
FIG. 1 is a front view of a multifunctional wheel burr removing device of the present application.
Figure 2:
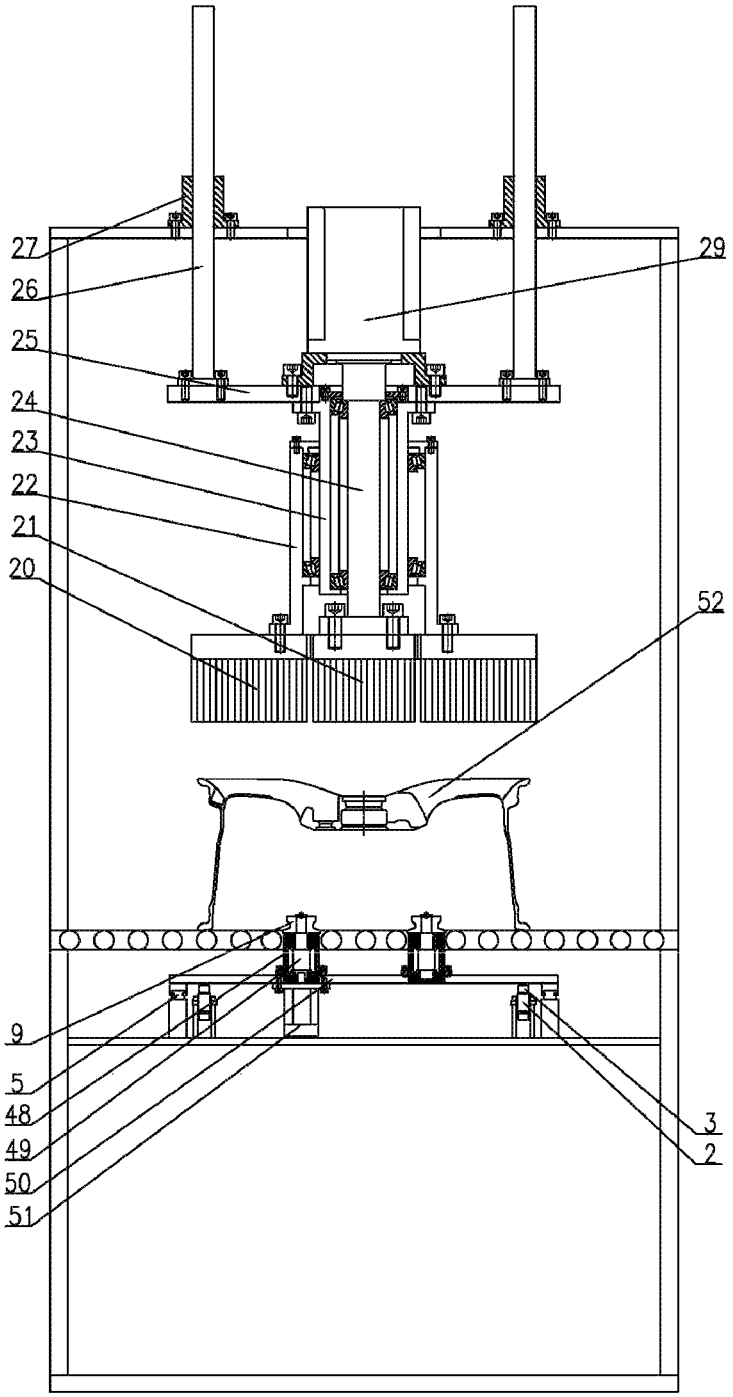
FIG. 2 is a left view of the multifunctional wheel burr removing device of the present application.
Figure 3:
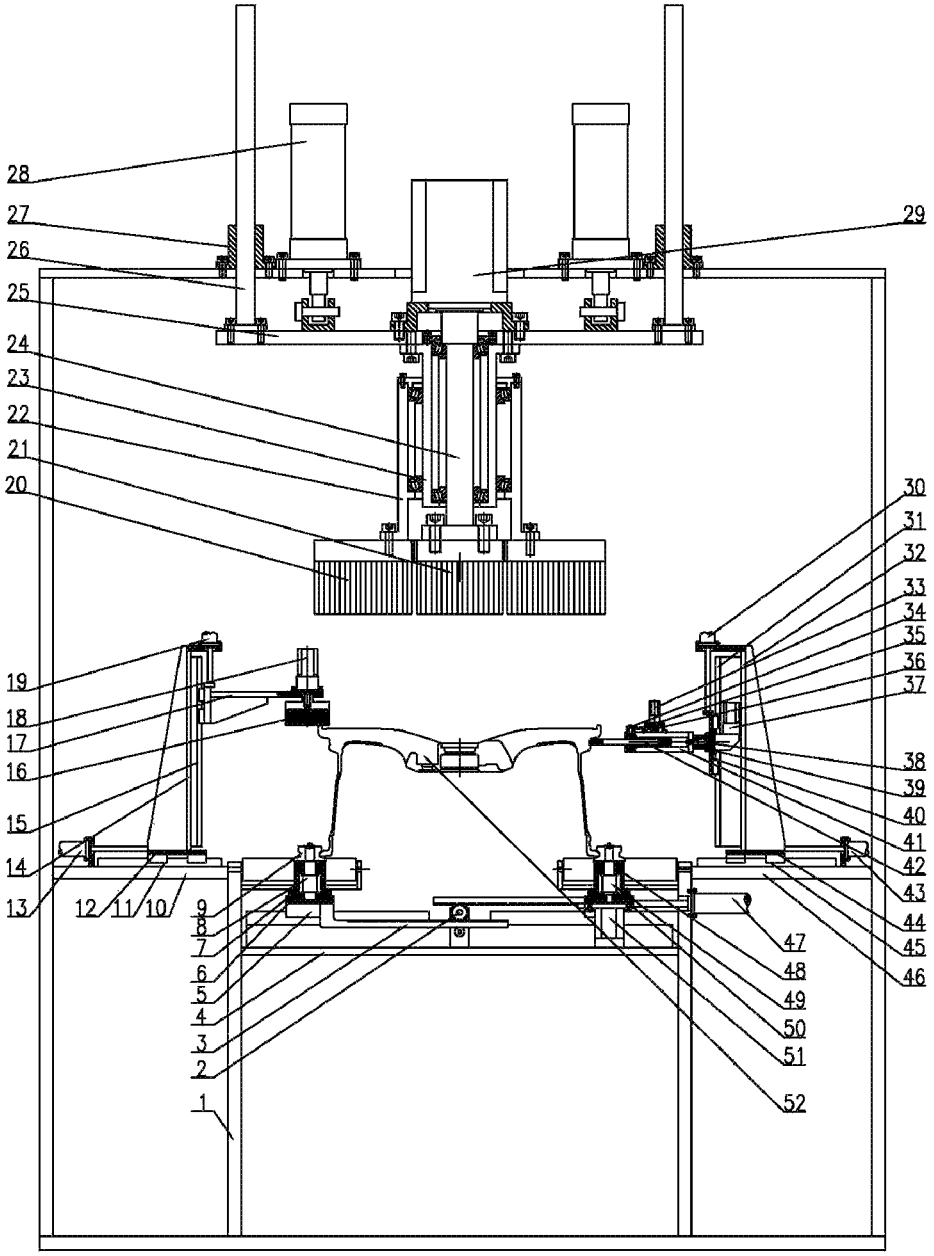
FIG. 3 is a left view when the multifunctional wheel burr removing device of the present application works.

In figures: 1—frame, 2—gear, 3—racks, 4—first bottom plate, 5—first guide rail, 6—first sliding plate, 7—first bearing seats, 8—first shafts, 9—V-shaped rollers, 10—first platform, 11—second guide rail, 12—second bottom plate, 13—first servo electric cylinder, 14—first vertical plate, 15—third guide rail, 16—first brush, 17—first lifting plate, 18—first motor, 19—second servo electric cylinder, 20—second ring brush, 21—first ring brush, 22—second bearing seat, 23—third bearing seat, 24—transmission shaft, 25—upper lifting plate, 26—guide posts, 27—guide sleeves, 28—cylinders, 29—upper motor, 30—third servo electric cylinder, 31—fourth guide rail, 32—second vertical plate, 33—first servo motor, 34—first belt pulley, 35—synchronous belt, 36—second belt pulley, 37—second servo motor, 38—second shaft, 39—fourth bearing seat, 40—second lifting plate, 41—second support frame, 42—second brush, 43—fourth servo electric cylinder, 44—third bottom plate, 45—fifth guide rail, 46—second platform, 47—fifth servo electric cylinder, 48—fifth bearing seats, 49—third shafts, 50—second sliding plate, 51—third servo motor, 52—wheel.

DETAILED DESCRIPTION OF THE INVENTION

Details and working conditions of a specific device provided by the embodiments will be described in combination with the accompanying drawings.

The device comprises a frame 1, a gear 2, two racks 3, a first bottom plate 4, a first guide rail 5, a first sliding plate 6, two first bearing seats 7, two first shafts 8, four V-shaped rollers 9, a first platform 10, a second guide rail 11, a second bottom plate 12, a first servo electric cylinder 13, a first vertical plate 14, a third guide rail 15, a first brush 16, a first lifting plate 17, a first motor 18, a second servo electric cylinder 19, a second ring brush 20, a first ring brush 21, a second bearing seat 22, a third bearing seat 23, a transmission shaft 24, an upper lifting plate 25, four guide posts 26, four guide sleeves 27, two cylinders 28, an upper motor 29, a third servo electric cylinder 30, a fourth guide rail 31, a second vertical plate 32, a first servo motor 33, a first belt pulley 34, a synchronous belt 35, a second belt pulley 36, a second servo motor 37, a second shaft 38, a fourth bearing seat 39, a second lifting plate 40, a second support frame 41, a second brush 42, a fourth servo electric cylinder 43, a third bottom plate 44, a fifth guide rail 45, a second platform 46, a fifth servo electric cylinder 47, two fifth bearing seats 48, two third shafts 49, a second sliding plate 50 and a third servo motor 51.

A synchronous clamping drive mechanism includes: the gear 2 is fixed above the first bottom plate 4; the first sliding plate 6 and the second sliding plate 50 are installed above the first bottom plate 4 via the first guide rail 5; below the first sliding plate 6 and the second sliding plate 50 are respectively fixed two racks 3, which are engaged with the gear 2; two first bearing seats 7 are fixed at the upper end of the first sliding plate 6; two fifth bearing seats 48 are fixed at the upper end of the second sliding plate 50; two first shafts 8 are installed in the first bearing seats 7 via bearings, and above the two first shafts 8 are respectively fixed a V-shaped roller 9; two third shafts 49 are installed in the fifth bearing seats 48 via bearings, and above the two third shafts 49 are respectively fixed a V-shaped roller 9, too; the fifth servo electric cylinder 47 is fixed on the right of the frame 1, and the output end of the fifth servo electric cylinder 47 is connected with the second sliding plate 50; the third servo motor 51 is fixed below the second sliding plate 50, and the output end of the third servo motor 51 is connected with the lower part of one of the third shafts 49.

A first burr brushing system includes: the second bottom plate 12 is installed above the first platform 10 via the second guide rail 11; the first vertical plate 14 is fixed above the second bottom plate 12; the first servo electric cylinder 13 is fixed on the left of the first platform 10, and the output end of the first servo electric cylinder 13 is connected with the second bottom plate 12; the first lifting plate 17 is installed on the right of the first vertical plate 14 via the third guide rail 15; the first motor 18 is fixed above the first lifting plate 17, and the output end of the first motor 18 is connected with the first brush 16; the second servo electric cylinder 19 is fixed at the top of the first vertical plate 14, and the output end of the second servo electric cylinder 19 is connected with the first lifting plate 17.

An upper burr brushing system includes: the third bearing seat 23 is fixed below the upper lifting plate 25; the transmission shaft 24 is installed inside the third bearing seat 23 via a bearing; the first ring brush 21 is fixed below the transmission shaft 24; the second bearing seat 22 is installed outside the third bearing seat 23 via a bearing, and the second ring brush 20 is fixed at the lower end of the second bearing seat 22; the second ring brush 20 is engaged with the first ring brush 21; the four guide posts 26 and the upper motor 29 are all fixed above the upper lifting plate 25; the output end of the upper motor 29 is connected with the upper part of the transmission shaft 24; the four guide sleeves 27 matched with the four guide posts 26 are all fixed at the top of the frame 1; two cylinders 28 are fixed at the top of the frame 1, and the output ends of the two cylinders 28 are articulated with the upper part of the upper lifting plate 25.

A second burr brushing system includes: the third bottom plate 44 is installed above the second platform 46 via the fifth guide rail 45; the fourth servo electric cylinder 43 is fixed above the second platform 46, and the output end of the fourth servo electric cylinder 43 is connected with the third bottom plate 44; the second vertical plate 32 is fixed above the third bottom plate 44; the second lifting plate 40 is installed on the left of the second vertical plate 32 via the fourth guide rail 31; the third servo electric cylinder 30 is fixed at the top of the second vertical plate 32, and the output end of the third servo electric cylinder 30 is connected with the upper part of the second lifting plate 40; the fourth bearing seat 39 is fixed on the left of the second lifting plate 40; the second shaft 38 is installed inside the fourth bearing seat 39 via a bearing; the second servo motor 37 is fixed on the right of the second lifting plate 40, and the output end of the second servo motor 37 is connected with the right of the second shaft 38; the right of the second support frame 41 is fixed on the left of the second shaft 38; the second brush 42 is installed inside the second support frame 41, and the first belt pulley 34 is fixed above an intermediate shaft of the second brush 42; the first servo motor 33 is fixed above the second support frame 41, and the second belt pulley 36 is fixed at the output end of the first servo motor 33; and the first belt pulley 34 is connected with the second belt pulley 36 via the synchronous belt 35.

In the working process, a wheel 52 has burrs on four parts, i.e., the end face of the upper rim, the wheel well, the sides of the upper rim and the front, and different wheels have different diameters and different heights, and the fifth servo electric cylinder 47 clamps a wheel 52 via the gear 2 and the racks 3, and the third servo motor 51 drives the clamped wheel 52 to rotate; the first servo electric cylinder 13 drives the first brush 16 via the second guide rail 11 to carry out feed motion towards the wheel, and the first motor 18 drives the first brush 16 to rotate; the second servo electric cylinder 19 drives the rotating first brush 16 via the third guide rail 15 to contact the end face of the upper rim of the wheel 52, thus removing burrs thereon; the upper motor 29 drives the first ring brush 21 to rotate via the transmission shaft 24, and the second ring brush 20 is driven to rotate by engagement of the first ring brush 21 and the second ring brush 20; the cylinders 28 drive the rotating first ring brush 21 and second ring brush 20 via the guide posts 26 to contact the front of the wheel 52, thus removing burrs on the front; the fourth servo electric cylinder 43 drives the second brush 42 via the fifth guide rail 45 to carry out feed motion towards the wheel; the first servo motor 33 drives the second brush 42 to rotate via the synchronous belt 35; the third servo electric cylinder 30 drives the second brush 42 to move up and down via the fourth guide rail 31, and when the rotating second brush 42 contacts the wheel well of the wheel 52, the burrs thereon can be removed; the second servo motor 37 drives the second brush 42 to turn over 90 degrees, the second brush 42 is vertical, and when the second brush 42 contacts the wheel 52, the cutting burrs on the side of the upper rim can be removed.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalent.

What is claimed is:

1. A multifunctional wheel burr removing device, comprising a frame, a gear, two racks, a first bottom plate, a first guide rail, a first sliding plate, two first bearing seats, two first shafts, four V-shaped rollers, a first platform, a second guide rail, a second bottom plate, a first servo electric cylinder, a first vertical plate, a third guide rail, a first brush, a first lifting plate, a first motor, a second servo electric cylinder, a second ring brush, a first ring brush, a second bearing seat, a third bearing seat, a transmission shaft, an upper lifting plate, four guide posts, four guide sleeves, two cylinders, an upper motor, a third servo electric cylinder, a fourth guide rail, a second vertical plate, a first servo motor, a first belt pulley, a synchronous belt, a second belt pulley, a second servo motor, a second shaft, a fourth bearing seat, a second lifting plate, a second support frame, a second brush, a fourth servo electric cylinder, a third bottom plate, a fifth guide rail, a second platform, a fifth servo electric cylinder, two fifth bearing seats, two third shafts, a second sliding plate and a third servo motor, wherein the multifunctional wheel burr removing device also comprises a synchronous clamping drive mechanism, a first burr brushing system, an upper burr brushing system and a second burr brushing system;

the synchronous clamping drive mechanism is as follows: the gear is fixed above the first bottom plate; the first sliding plate and the second sliding plate are installed above the first bottom plate via the first guide rail; below the first sliding plate and the second sliding plate are respectively fixed two racks, and the racks are engaged with the gear; two first bearing seats are fixed at an upper end of the first sliding plate; two fifth bearing seats are fixed at an upper end of the second sliding plate; two first shafts are installed in the first bearing seats via bearings, and above the two first shafts are respectively fixed a V-shaped roller; two third shafts are installed in the fifth bearing seats via bearings, and above the two third shafts are respectively fixed a V-shaped roller; the fifth servo electric cylinder is fixed on the right of the frame, and the output end of the fifth servo electric cylinder is connected with the second sliding plate; the third servo motor is fixed below the second sliding plate, and an output end of the third servo motor is connected with the lower part of one of the third shafts;

the first burr brushing system is as follows: the second bottom plate is installed above the first platform via the second guide rail; the first vertical plate is fixed above the second bottom plate; the first servo electric cylinder is fixed on the left of the first platform, and an output end of the first servo electric cylinder is connected with the second bottom plate; the first lifting plate is installed on the right of the first vertical plate via the third guide rail; the first motor is fixed above the first lifting plate, and an output end of the first motor is connected with the first brush; the second servo electric cylinder is fixed at the top of the first vertical plate, and an output end of the second servo electric cylinder is connected with the first lifting plate;

the upper burr brushing system is as follows: the third bearing seat is fixed below the upper lifting plate; the transmission shaft is installed inside the third bearing seat via a bearing; the first ring brush is fixed below the transmission shaft; the second bearing seat is installed outside the third bearing seat via a bearing, and the second ring brush is fixed at the lower end of the second bearing seat; the second ring brush is engaged with the first ring brush; the four guide posts and the upper motor are all fixed above the upper lifting plate; the output end of the upper motor is connected with the upper part of the transmission shaft; the four guide sleeves matched with the four guide posts are all fixed at the top of the frame; the two cylinders are fixed at the top of the frame and the output ends of the two cylinders are articulated with the upper part of the upper lifting plate;

the second burr brushing system is as follows: the third bottom plate is installed above the second platform via the fifth guide rail; the fourth servo electric cylinder is fixed above the second platform, and an output end of the fourth servo electric cylinder is connected with the third bottom plate; the second vertical plate is fixed above the third bottom plate; the second lifting plate is installed on the left of the second vertical plate via the fourth guide rail; the third servo electric cylinder is fixed at the top of the second vertical plate, and the output end of the third servo electric cylinder is connected with the upper part of the second lifting plate; the fourth bearing seat is fixed on the left of the second lifting plate; the second shaft is installed inside the fourth bearing seat via a bearing; the second servo motor is fixed on the right of the second lifting plate, and an output end of the second servo motor is connected with the right of the second shaft; the right of the second support frame is fixed on the left of the second shaft; the second brush is installed inside the second support frame and the first belt pulley is fixed above an intermediate shaft of the second brush; the first servo motor is fixed above the second support frame, and the second belt pulley is fixed at an output end of the first servo motor; and the first belt pulley is connected with the second belt pulley via the synchronous belt;

in practical use, the fifth servo electric cylinder clamps a wheel via the gear and the racks, and the third servo motor drives the clamped wheel to rotate; the first servo electric cylinder drives the first brush via the second guide rail to carry out feed motion towards the wheel, and the first motor drives the first brush to rotate; the second servo electric cylinder drives the rotating first brush via the third guide rail to contact the end face of the upper rim of the wheel, thus removing burrs thereon; the upper motor drives the first ring brush to rotate via the transmission shaft, and the second ring brush is driven to rotate by engagement of the first ring brush and the second ring brush; the cylinders drive the rotating first ring brush and second ring brush via the guide posts to contact the front of the wheel, thus removing burrs on the front; the fourth servo electric cylinder drives the second brush via the fifth guide rail to carry out feed motion towards the wheel; the first servo motor drives the second brush to rotate via the synchronous belt; the third servo electric cylinder drives the second brush to move up and down via the fourth guide rail, and when the rotating second brush contacts the wheel well of the wheel, the burrs thereon can be removed; the second servo motor drives the second brush to turn over 90 degrees, the second brush is vertical, and when the second brush contacts the wheel, the burrs on the side of the upper rim can be removed.

* * * * *